US009863111B2

(12) United States Patent
Becker et al.

(10) Patent No.: US 9,863,111 B2
(45) Date of Patent: Jan. 9, 2018

(54) VIBRATION TAMPER

(71) Applicant: BOMAG GmbH, Boppard (DE)

(72) Inventors: Jost Becker, Koblenz (DE); Albertus Krings, Kadenbach (DE)

(73) Assignee: BOMAG GmbH, Boppard (DE)

( * ) Notice: Subject to any disclaimer, the term of this patent is extended or adjusted under 35 U.S.C. 154(b) by 91 days.

(21) Appl. No.: 14/103,348

(22) Filed: Dec. 11, 2013

(65) Prior Publication Data

US 2014/0161541 A1 Jun. 12, 2014

(30) Foreign Application Priority Data

Dec. 11, 2012 (DE) ..... 10 2012 024 222

(51) Int. Cl.

| | |
|---|---|
| ***E01C 19/24*** | (2006.01) |
| ***E01C 19/32*** | (2006.01) |
| ***E02D 3/026*** | (2006.01) |
| ***E01C 19/26*** | (2006.01) |
| ***E01C 19/28*** | (2006.01) |

(Continued)

(52) U.S. Cl.

CPC ..... *E02D 3/046* (2013.01); *E01C 19/38* (2013.01)

(58) Field of Classification Search

CPC . E02D 3/02; E02D 3/026; E01C 19/30; E01C 19/32; E01C 19/34; E01C 19/35

See application file for complete search history.

(56) References Cited

U.S. PATENT DOCUMENTS 3,236,164 A * 2/1966 Miller ..... 404/133.1
3,664,315 A * 5/1972 Kramer ..... F02M 21/0212 123/445

(Continued)

FOREIGN PATENT DOCUMENTS

DE 2 226 689 A1 12/1973
DE 3516582 A1 * 11/1986 ..... F02D 17/04

(Continued)

OTHER PUBLICATIONS

ESPACENET, English Machine Translation of Claims for DE2226689A1, published Dec. 13, 1973 (2 pages).

(Continued)

*Primary Examiner* — Tara Mayo-Pinnock

(74) *Attorney, Agent, or Firm* — Wood Herron & Evans LLP

(57) ABSTRACT

The present invention relates to a vibration tamper, comprising a superstructure having a driving engine mounted on a machine frame and further having a guide bar, and further comprising a substructure having a compactor base driven by the driving engine and having a compactor plate and having a drive line, by means of which a drive connection between the driving engine and the compactor base is established such that the compactor base can move relatively to the superstructure along a compactor axis while executing at least one compacting amplitude. The driving engine of the vibration tamper is a liquid gas powered driving engine, wherein the superstructure and, more particularly, the guide bar on the superstructure, comprises a storage container for liquid gas, and wherein a gas supply line is provided to supply evaporated liquid gas to the driving engine.

14 Claims, 4 Drawing Sheets

(51) Int. Cl.
*E02D 3/046* (2006.01)
*E01C 19/38* (2006.01)

(56) References Cited

U.S. PATENT DOCUMENTS 3,710,809 A * 1/1973 Brown ..... F02M 21/0212 137/1
5,645,370 A * 7/1997 Zurbes ..... B06B 1/14 404/133.05
6,000,879 A * 12/1999 Greppmair ..... E02D 3/046 404/133.05
6,019,179 A * 2/2000 Zurbes ..... B06B 1/14 173/162.2
6,206,027 B1 3/2001 Ponnet et al.
6,213,681 B1 4/2001 Sick et al.
D517,094 S * 3/2006 Stein ..... D15/20

FOREIGN PATENT DOCUMENTS

DE 201 05 768 U1 6/2001
DE 10 2009 017 209 B4 5/2011
DE 10 2010 046 820 A1 3/2012
DE 10 2010 047 943 A1 4/2012
DE 10 2011 105 899 A1 1/2013
EP 0 998 609 B1 5/2000

OTHER PUBLICATIONS

ESPACENET, English Machine Translation of DE20105768U1, published Jun. 21, 2001, retrieved from http://worldwide.espacenet.com on Dec. 7, 2013 (5 pages).
ESPACENET, English Machine Translation of DE102009017209B4, published May 5, 2011, retrieved from http://worldwide.espacenet.com on Dec. 7, 2013 (10 pages).
ESPACENET, English Machine Translation of DE102010046820A1, published Mar. 29, 2012, retrieved from http://worldwide.espacenet.com on Dec. 7, 2013 (13 pages).
ESPACENET, English Machine Translation of DE102010047943A1, published Apr. 12, 2012, retrieved from http://worldwide.espacenet.com on Dec. 7, 2013 (8 pages).
ESPACENET, English Machine Translation of DE102011105899A1, published Jan. 3, 2013, retrieved from http://worldwide.espacenet.com on Dec. 7, 2013 (13 pages).
German Patent Office, Search Report for DE102012024222.0, dated Aug. 22, 2013 (4 pages).
United States Patent and Trademark Office, Office Action, U.S. Appl. No. 14/103,423, dated Mar. 13, 2014 (12 pages).
United States Patent and Trademark Office, Final Office Action, U.S. Appl. No. 14/103,423, dated Sep. 8, 2014 (7 pages).
United States Patent and Trademark Office, Advisory Action, U.S. Appl. No. 14/103,423, dated Jan. 28, 2015 (3 pages).
United States Patent and Trademark Office, Office Action, U.S. Appl. No. 14/103,423, dated Feb. 27, 2015 (7 pages).
United States Patent and Trademark Office, Final Office Action, U.S. Appl. No. 14/103,423, dated Jul. 20, 2015 (7 pages).
United States Patent and Trademark Office, Advisory Action, U.S. Appl. No. 14/103,423, dated Oct. 28, 2015 (2 pages).
United States Patent and Trademark Office, Office Action, U.S. Appl. No. 14/103,423, dated Dec. 3, 2015 (8 pages).
United States Patent and Trademark Office, Final Office Action, U.S. Appl. No. 14/103,423, dated Jun. 15, 2016 (13 pages).

* cited by examiner

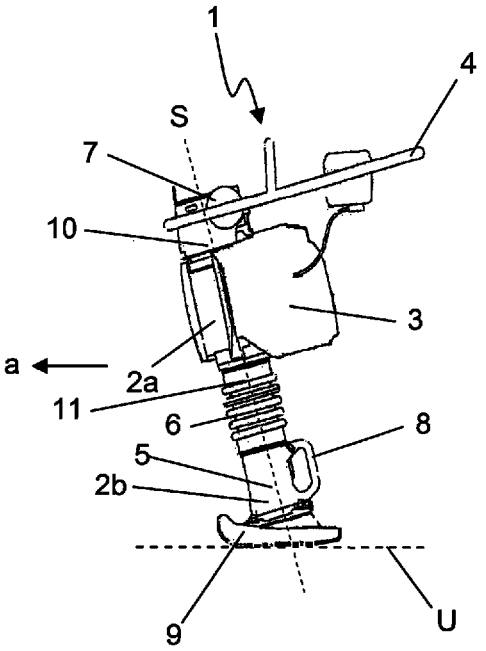
Fig. 1
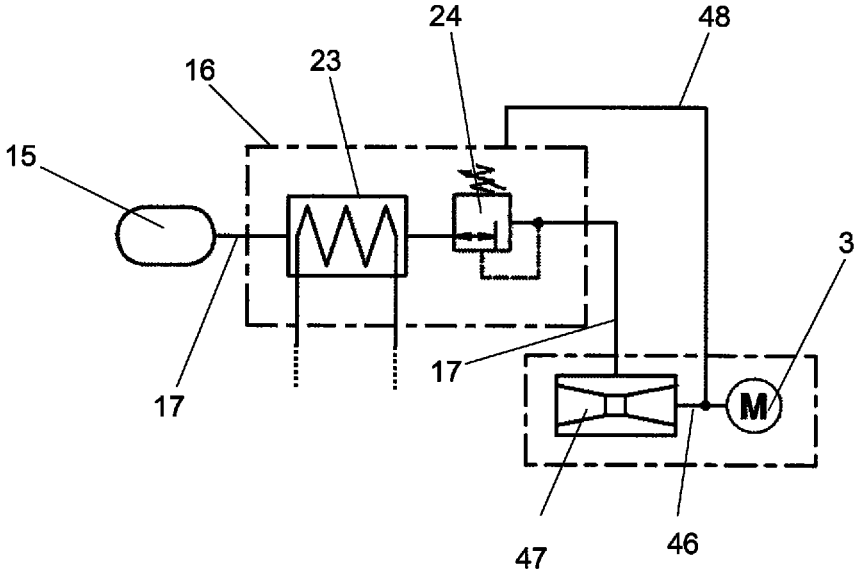
Fig. 7
Fig. 8
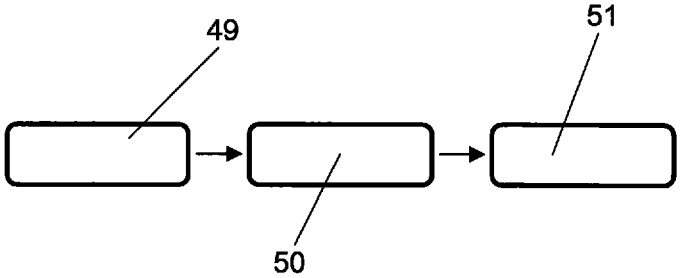

Fig. 2a
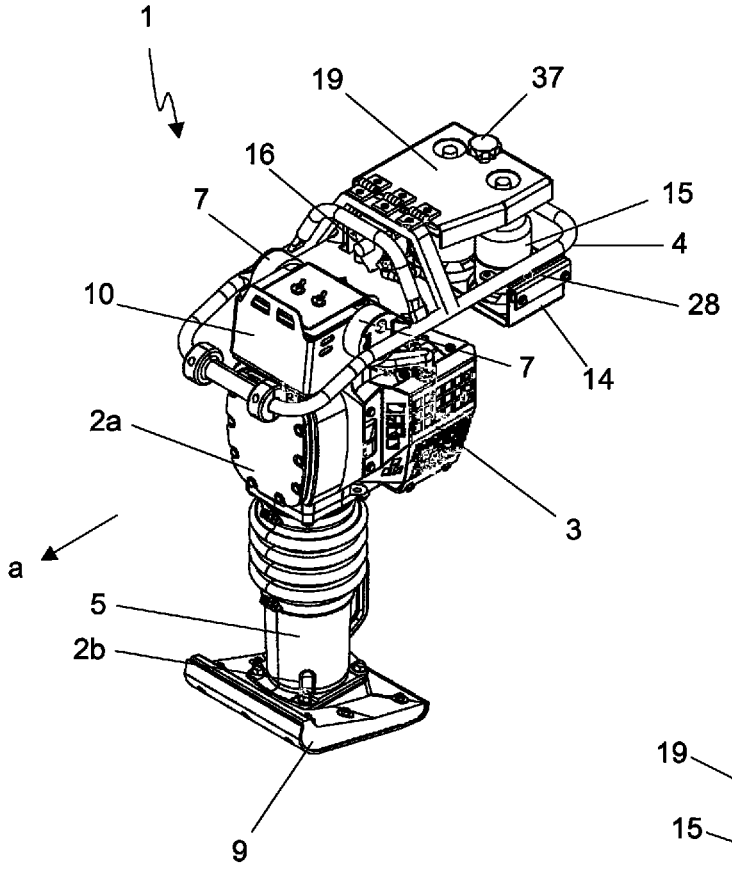
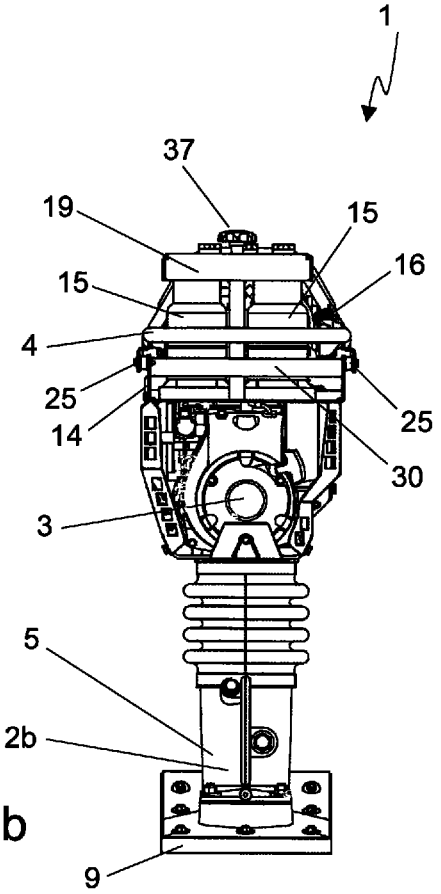
Fig. 2b

VIBRATION TAMPER

RELATED APPLICATION

The present application is related to co-pending U.S. Ser. No. 14/103,423, filed Dec. 11, 2013, and entitled Hand-Guided Ground Compacting Machine.

CROSS-REFERENCE TO RELATED APPLICATIONS

The present application claims priority under 35 U.S.C. §119 of German Patent Application No. 10 2012 024 222.0, filed Dec. 11, 2012, the disclosure of which is hereby incorporated herein by reference in its entirety.

FIELD OF THE INVENTION

The present invention relates to a vibration tamper for ground compaction.

BACKGROUND OF THE INVENTION

A generic vibration tamper includes a superstructure comprising a driving engine mounted on a machine frame and further comprising a guide bar, and further includes a substructure comprising a compactor base driven by the driving engine and comprising a compactor plate and a drive line, by means of which a drive connection between the driving engine and the compactor base is established such that the compactor base is capable of moving relatively to the superstructure along a compactor axis while executing at least one compacting amplitude. A generic vibration tamper is, for example, disclosed in DE 201 05 768 U1 owned by the Applicant, the disclosure of which is incorporated herein by reference. In the case of this vibration tamper, the power output of the driving engine communicates via a connecting rod with the compactor base and converts the rotational motion of the output shaft of the driving engine to linear motion, that is to say, to compacting motion of the compactor base. Vibration tampers are usually classified as so-called manually guided "walk behind" machines. For this purpose, the vibration tamper comprises, as part of the superstructure, a guide bar mounted on the superstructure via usually resilient damping elements on the machine frame. The machine frame is substantially a single-piece or multi-piece supporting structure, particularly, for the driving engine and/or the guide bar on the superstructure. The measures used for establishing such vibration attenuation are known per se. For example, suitable rubber mountings or similar vibration damping devices can be used for this purpose. The main property of the damping elements used is that vibration incited therein by the machine frame are either completely eliminated in the damping element or are damped and then transferred to the other side with an attenuated intensity. In operation, an operator can manually guide the vibration tamper over the surface to be compacted, by means of the guide bar on the superstructure. Generic vibration tampers are also disclosed, for example, in DE 10 2009 017 209 B4, DE 10 2010 046 820 A1 and DE 10 2010 047 943 A1 owned by the Applicant. These specifications are likewise incorporated herein by reference with regard to their construction and the manner of operation of generic vibration tampers.

The majority of driving engines used for generic vibration tampers are internal combustion engines that provide the necessary mechanical energy for operation of the vibration tampers for ground compaction by burning gasoline or diesel fuel. The numerous machines usually present on a building site together lead to considerable exhaust pollution for the persons active on the building site. Problems are posed, in particular, by the regularly occurring high carbon monoxide concentrations and possibly by soot contamination. This set of problems is particularly conspicuous when a vibration tamper is used in situations in which only a restricted working space is available, only small areas require compacting, and/or selective compacting measures are desired, as, for example, in trench and canal engineering. Alternatively, DE 10 2011 105 899.4 owned by the Applicant also discloses a vibration tamper operated on electrical energy. Especially the accumulators necessary, therefore, are, however, still relatively expensive, and the operating periods thus attainable are comparatively short. Another basic objective to be regarded when developing vibration tampers consists in that safe and reliable operation should be made possible in spite of the high vibratory stress naturally occurring under working conditions.

It is thus an object of the present invention to provide a vibration tamper that makes it possible to achieve comparatively low-emission working conditions and is at the same time inexpensive to produce and is also capable of achieving comparatively long operating periods.

SUMMARY OF THE INVENTION

One aspect of the present invention resides in the provision of a liquid gas powered driving engine to produce the driving energy necessary for operation of the vibration tamper. Liquid gas is generally also known as LPG (liquefied petroleum gas) or autogas. Liquid gas is substantially composed of the main constituents propane and butane, of which the respective proportions can vary. Liquid gas is in its normal state a gaseous combustible gas, which can be liquefied at a temperature as low as 20° C. under a pressure of 8 bar. A liquid gas powered driving engine is, thus, to be understood as a driving engine whose automotive fuel is evaporated liquid gas, which induces, during a combustion process taking place in the driving engine, expansion processes such as are typical of internal combustion engines. Liquid gas has the advantage over the hitherto regularly used automotive fuels diesel and gasoline that it burns in the combustion chamber of the driving engine more uniformly and almost free from soot. In addition, the carbon monoxide concentration of the exhaust gas is much lower. For the supply of automotive fuel to the driving engine, a gas supply pipe is provided according to the present invention, through which evaporated liquid gas can be fed to the driving engine. According to the present invention, provision is also made for at least one storage container to be present on the vibration tamper itself for the purpose of storing liquid gas so that under working conditions a stock of liquid gas can accompany the vibration tamper. The at least one storage container is, thus, connected to the gas supply line, that is, a piping system on the vibration tamper, and supplies the driving engine with liquid gas. This storage container is thus, generally speaking, a pressure vessel, in which liquid gas can be stored in the liquid state and can accompany the vibration tamper under working conditions. The storage container is, thus, a tank for liquid gas. The piping system is generally configured such that it establishes fluid communication between the driving engine and the storage container, in order to enable a gastight transfer of the liquefied gas from the at least one storage container to the driving engine when the latter is running. For this purpose, the piping system comprises suitable rigid and/or flexible pipes and appropriate connecting means for connection to the storage container and to the driving engine.

According to one embodiment of the present invention, the at least one storage container is also disposed on the superstructure of the vibration tamper. This arrangement has the advantage that, for example, the mechanical load on the superstructure is much lower than on the substructure. An additional advantageous effect is that the at least one storage container and the driving engine are, thus, close to each other.

According to one embodiment of the present invention, it is possible for the at least one storage container to be fixed to the superstructure of the vibration tamper. Thus, filling of the at least one storage container takes place in this case directly on the vibration tamper. In order to achieve, as far as possible, self-sufficient operation of the vibration tamper, it is preferable, however, for the at least one storage container to be replaceably disposed on the superstructure and, more particularly, on the guide bar on the superstructure of the vibration tamper. For the purpose of refilling, an empty storage container can then be simply and quickly replaced by a full storage container, with the result, for example, that the down times of the vibration tamper can be considerably reduced.

For the purpose of attaching the at least one storage container to the superstructure of the vibration tamper, preferably storage container holding means are present on the superstructure of the vibration tamper, such as a storage container holder, which mounting means are adapted for accommodating and mounting the at least one storage container on the vibration tamper. Its main purpose is to achieve secure attachment and mounting of the storage container on the superstructure of the vibration tamper. In order to guarantee, in particular, smooth and reliable working conditions, it is now preferable, according to the present invention that the storage container holding means be vibration-cushioned in relation to vibration induced, in particular, by the machine frame. Thus, in other words, there is at least one damping stage present between the machine frame and the storage container holding means, which damping stage eliminates or at least damps the vibration passing from the machine frame to the storage container holding means and thus also to the at least one storage container disposed therein or thereon. This ensures that the at least one storage container at least partially filled with liquid gas is not subjected to the full intensity of vibration induced by the machine frame and thus, under working conditions, only a considerably reduced transfer of vibration takes place from the machine frame to the at least one storage container.

Basically, a large number of possible positions are likewise suitable for arranging the vibration-cushioned storage container holding means on the superstructure of the vibration tamper. It is preferred, however, that the storage container holding means are disposed, in particular, either directly, or exclusively via a damping device, on the guide bar. Thus, the guide bar is in the present case expressly part of the superstructure of the vibration tamper. This arrangement has the advantage that the vibration attenuating means usually already present for the guide bar can at the same time be utilized for vibration attenuation of the storage container holding means. Thus, the vibration attenuation for the storage container holding means is in other words provided by way of the vibration attenuation for the guide bar relatively to the machine frame. Starting from this embodiment, however, the vibration attenuation for the storage container holding means can still be enhanced further by providing additional vibration attenuation between the storage container holding means and the guide bar. Thus, the storage container holding means are in this embodiment mounted on the guide bar via suitable vibration damping elements. Between the machine frame and the storage container holding means there are thus present, in this embodiment, two successive damping stages, one between the machine frame and the guide bar on the superstructure and one between the guide bar and the storage container holding means. In all, particularly efficient vibration attenuation is obtained for the storage container disposed in the storage container holding means.

Vibration tampers frequently incorporate guide bars that make it possible to guide the vibration tamper both from the rear and from the front in relation to the machine direction of the vibration tamper. It has proven to be advantageous especially for this kind of guide bar when the storage container holding means are disposed on the guide bar, as regarded in the main working direction, between the guide bar mount on the machine frame and the rear region of the holding portion, or grasping region, of the guide bar. The guide bar mount is that portion of the guide bar, on which the guide bar is articulated to the machine frame, particularly by means of one or more vibration damping elements. Thus, the storage container holding means are, in other words, positioned to the rear of the guide bar, as regarded in the main working direction. The rear region of the holding portion of the guide bar is that region which is grasped by an operator standing behind the vibration tamper. The main working direction is that direction in which the vibration tamper is predominantly moved under working conditions. In the case of vibration tampers in which the compactor axis is tilted relatively to the road subsurface, this is, for example, that direction in which the compactor axis is tilted with respect to the road subsurface. This arrangement of the storage container holding means is advantageous in that the storage container holding means and the at least one storage container then act as a kind of counterweight for the inclination of the ground compacting machine.

It is optimal when the storage container holding means are disposed between two side beams of the guide bar. The guide bar is as a rule at least partially U-shaped and can additionally be more or less three-dimensionally distorted. In the end region of the two U-shaped portions, it is articulated to the machine frame in a vibration-cushioned manner. Especially, the connecting member between the two lateral arms or beams of the guide bar is frequently implemented as the grasping region for the machine operator, so that the attachment of the storage container holding means in this region would not be advantageous. The arrangement of the storage container holding means between the two side beams can also readily obviate any one-sided influence of the weight distribution of the ground compacting machine so as to impair, for example, the standing stability of the ground compacting machine. Simultaneous mounting of the storage container holding means on both side beams gives rise to a particularly stable holder and is thus preferred.

As stated above, it is advantageous, however, when the at least one storage container is replaceably disposed on the superstructure and, more particularly, in or on the storage container holding means. This means that the at least one storage container is thus dismantled and removed for the purpose of filling the vibration tamper up with fuel. Thus, the term "replaceably" is for the purposes of the present invention to be understood to mean, in particular, that provision is made for quick routine mounting and dismounting of the at least one storage container on and from the storage container holding means. This possibility has the advantage that filling of the storage containers can be carried out apart from the vibration tamper and in this way, for example, during the process of filling up at least one empty storage container, continued operation of the vibration tamper on at least one filled storage container is possible parallel thereto. The replacement should ideally take place in as uncomplicated a manner as possible and within a short period, for example, a few minutes.

Ideally, therefore, attachment means for the purpose of connecting the at least one storage container to a vibration tamper of the present invention are preferably present, which attachment means comprise at least one quick coupling system. Basically, attachment facilities known per se for the attachment of liquid gas tanks to conduit systems can be used for attaching the at least one storage container. The quick coupling system is, however, characterized in that it achieves, in a comparatively simple but at the same time reliable manner, secure connection and disconnection between the at least one storage container and the piping system. In an optimal solution, the quick coupling system is one which can be operated without the use of tools. A quick coupling system is operable without tools when the establishment and release of the coupled connection by the attachment means between the storage container and the piping system can be achieved purely manually and without the assistance of tools. The advantage of this is that there is then no need for specific tools to be available for attaching and/or removing the at least one storage container from the attachment means. A suitable quick coupling system is characterized in that it ensures, for example, that a coupled connection is first of all established between the storage container and the attachment means and only then is a valve orifice opened for the transfer of liquid gas from the storage container to the piping system. The quick coupling system can thus be in the form of, for example, a rotary locking means, more particularly, a bayonet type locking means, which first of all creates a closure and then opens a valve orifice, and in the case of the removal of the storage container first of all closes a valve orifice and only then disconnects the coupling.

The storage container holding means preferably comprise a holding device, which is configured to releasably fix the at least one storage container in the storage container holding means. The holding device is thus characterized in that it releasably fixes the position of the at least one storage container in the storage container holding means, such that this maintains a defined position in the storage container holding means, for example, under working conditions. Such a holding device can, for example, be a quick action strap, a spring lock, a retaining plate or the like. The holding device can, in particular, be part of a protective cover, as explained below in more detail. Furthermore, the holding device is preferably configured such that it locks the at least one storage container in or on the at least one storage container holding means in a form-locking and/or force-locking manner.

Basically, different storage containers can be employed, storage containers having a maximum capacity for liquid gas ranging from 200 ml to 20 000 ml, more particularly, from 400 ml to 1000 ml, having proven to be particularly preferable. The latter are, for example, frequently legally permitted to be refilled by the machine operator himself, so that there is no need to call on the services of special filling personnel. Further conventional sizes for liquid gas tanks are gas cylinders having filling capacities of 5 kg and 11 kg, which may basically also be used.

It is ideal when the at least one storage container is a cartridge, more particularly, a screw valve type cartridge or a bayonet valve type cartridge. By a "cartridge" is in this case a small gas cylinder to be understood, which has a capacity of not more than 1000 ml. The use of cartridges is advantageous in that they are comparatively lightweight and small and thus provide an optimal compromise between the operating period possible on one filling, in particular, in case of the use of a plurality of cartridges on the vibration tamper, and weight. Screw valve type cartridges or bayonet valve type cartridges are characterized in that they comprise a screw valve type connector or a bayonet valve type connector and can thus be connected directly to the piping system of the vibration tamper via a suitable attachment means.

In particular, taking into consideration the presently available storage container sizes for liquid gas, it is further advantageous when the storage container holding means is configured to accommodate at least two storage containers. This makes it possible to use smaller storage containers while simultaneously prolonging the maximum possible operating period on one total filling of the vibration tamper with liquid gas. An operating period denotes the maximum period of time during which the vibration tamper can be run on a total filling at average liquid gas consumption, i.e., when use is made of a plurality of storage containers, based on the capacity of all storage containers, without re-filling. Basically, the use of smaller storage containers is advantageous in that they can be frequently legally permissibly filled by a so-called authorized person on site at suitable mobile filling stations, so that the operator of such a vibration tamper, for example, need keep only a small number of suitable storage containers available on the premises.

If a plurality of storage containers are used, they are optimally connected in parallel, so that it is possible to draw liquid gas simultaneously from all of the storage containers present. The piping system of the vibration tamper comprises in this case preferably an attachment means for achieving parallel connection of the at least two storage containers to the piping system. The attachment means can for this purpose, for example, be configured in the form of a T-shaped piece for at least two storage containers or a kind of connecting bar having one gas outlet pipe and a plurality of gas inlet pipes or a plurality of connectors for each storage container. Ideally the attachment means further comprises, for the connecting side of the at least two storage containers, at least one suitable safety device configured such that it causes closure of the attachment means if no storage container is connected to the respective connector for a storage container. This feature is important in that when at least one storage container is attached or removed, it is necessary to detach this storage container from the attachment means and in this case to carefully avoid the outflow of liquefied gas possibly still present from any other storage container installed on the attachment means. For this purpose, suitable check valves or the like can, for example, be provided before each connector of a storage container on the attachment means, which check valve automatically closes the connector from the environment when a storage container is removed.

The objective of the storage container holding means according to one embodiment resides in making it possible to ensure safe and reliable attachment of the at least one storage container to the vibration tamper. The storage container holding means can, for example, comprise a hanger or similar bearing elements for accommodating the at least one storage container. Ideally, the storage container holding means are however in the form of a receiver trough comprising a plate and at least two vertically erect side walls, between which the at least one storage container can be set on said plate. By way of the side walls there is ideally achieved a connection of the receiver trough to the guide bar, more particularly, to the opposing lateral arms thereof. In this way, storage container holding means are obtained that are simple to produce and are at the same time extremely stable.

Preferably, the storage container holding means comprise a lateral guard, which at least partially shields the at least one storage container in the storage container holding means from side influences. The term "side" relates, in particular, to the external marginal regions of the storage container holding means lying in the horizontal plane. The lateral guard can consist, for example, of one or more wall elements, which at least partially guarantee external delimitation of the storage container holding means. The lateral guard must not necessarily be in the form of a continuous face, but may be a broken surface or be grid shaped to form a protective grille. It is important that the lateral guard makes it possible to provide at least one external coarse shielding means for the at least one storage container, in order to prevent or at least hinder, for example, the penetration of environmental influences into the interior of the storage container holding means. Ideally, the lateral guard is configured at least to an extent such that it provides, in particular, protection of the at least one storage container at the level of the attachment means, in order to prevent, for example, an unintentional disconnection of the valve connection between the piping system and the at least one storage container should the vibration tamper topple over.

Further, a protective cover may be present that is adapted to at least partially cover at least one storage container disposed in the storage container holding means. The protective cover makes it possible, in particular, to provide upward protection for the at least one storage container or to protect the at least one storage container vertically from above. The protective cover is therefore also preferably used in combination with the lateral guard. The protective cover accordingly prevents the at least one storage container from being unintentionally damaged from above. In addition, the protective cover can basically have openings therein and/or be configured in a grid-like manner, but in this case the configuration of the protective cover as a continuous surface has proven to be preferable.

In order to make it possible, for example, to have access to the interior of the storage container holding means for the purpose of replacing the at least one storage container, the protective cover is ideally movably and, in particular, rotatable, mounted on the guide bar. For the purpose of exchanging the at least one storage container, the protective cover can thus be removed, for example, pivoted up, and after the replacement has taken place remounted, for example, pivoted down. In order to make it possible to cover the at least one storage container in a reliable manner by means of the protective cover, the latter is preferably provided with a locking mechanism, more particularly, a suitable screw-on type cap, for the purpose of arresting the protective cover in a closed position. The screw-on type cap is, in particular, captively disposed on the protective cover, so as to prevent, for example, loss of the cap when the at least one storage container is replaced.

Ideally, the protective cover according to one embodiment is in the form of a pivoted hood, which is, in particular, substantially flat and comprises a completely closed hood element.

As described above, there is disposed in the storage container holding means preferably a holding device, by means of which the position of the at least one storage container in the storage container holding means is guaranteed. It is now preferred to configure this holding device at least partially as part of the protective cover, so that the protective cover carries out, beyond the purely protective function, an additional retaining function. Basically, the holding device disposed on the protective cover can be varied in a number of ways. It is optimal, for example, when the holding device comprises a resilient pressure applying element that is configured such that it exerts a contact pressure effective in the closing direction of the protective cover onto the at least one storage container in the storage container holding means. In other words, closing of the protective cover preferably causes the resilient pressure applying element to bear, directly or indirectly, against the at least one storage container and is at least partially compressed by further closing of the protective cover. The resulting contact pressure on the at least one storage container is now preferably utilized so as to acquire positional stabilization of the at least one storage container in the storage container holding means. Specifically, the holding device can comprise for this purpose, for example, a retaining and protective sleeve, which in the holding state, i.e., when the protective cover is closed, comes to bear at least partially with its marginal end region against the at least one storage container. The retaining and protective sleeve is, thus, preferably pressed downwardly against the at least one storage container, wherein it optimally surrounds, at least partially, connecting means for connecting the at least one storage container to the piping system of the vibration tamper, by which means there is achieved mechanical protection especially of this sensitive region. Alternatively, the sleeve can be a protective tube only and used as such.

As described above, the at least one storage container serves to accommodate and store liquid gas in the liquid state of aggregation. However, the driving engine burns the liquid gas in the gaseous state. In order to achieve a gas supply to the driving engine under constant pressure conditions, the piping system thus preferably comprises a pressure governor, more particularly, an automatically regulating pressure governor, between the at least one storage container and the internal combustion engine. Thus, the objective of the pressure governor is to adjust the pressure of the gaseous liquefied gas guided to the driving engine to a constant level, in order to guarantee a constant gas pressure and, thus, to provide undisturbed working conditions.

Preferably, in the piping system there is additionally present, between the at least one storage container and the driving engine, an evaporator serving the purpose of ensuring complete volatilization of the liquefied gas. The physical properties of liquid gas can result, particularly at low external temperatures, in the liquid gas passing to the driving engine under working conditions at least partially in liquid form. In order to prevent this, the evaporator is appropriately interposed, according to one embodiment of the present invention, between the at least one storage container and the driving engine for the main purpose of transforming the liquid liquefied gas to gaseous liquid gas. Such evaporators are known per se. It is further preferred that the evaporator is disposed in the piping system as close as possible to the at least one storage container, in order to keep the concentration of liquid gas in the entire piping system as low as possible.

In order to optimize the mode of operation of the evaporator further, it can preferably also comprise a heat input port, by means of which thermal energy is fed to the evaporator for volatilization of liquid liquefied gas. It is optimal for this purpose, for example, when the cooling air warmed by the driving engine is fed to said heat input port, as may be achieved, for example, by providing an appropriate path for the cooling air. Additionally, or alternatively, is it preferable to feed to said heat input port heat contained in an oil circulation supplied with engine oil. This engine oil fed to the driving engine in a lubricant circulation likewise heats up under working conditions, so that branching-off of the oil towards the evaporator can also be used as an additional measure for the purpose of cooling the engine oil. Both variants have the advantage that they feed to the evaporator thermal energy resulting from the combustion of gaseous liquid gas in the driving engine and, thus, make more efficient exploitation of energy possible.

Optimal operation is, thus, possible when the piping system includes both an evaporator and a pressure governor, in which case the evaporator is disposed in the piping system upstream of the pressure governor, as regarded in the direction of flow towards the motor. Optimally in one embodiment, the evaporator and the pressure governor are combined in a common machine element, by which means a particularly efficient construction of the entire system is achieved. A combined component is present when it combines the two functional subunits "evaporator" and "pressure governor" in a common unit or in a common module.

With regard to achieving reliable and regulated working conditions, the evaporator and/or the pressure governor thus assume a central significance. It is, therefore, preferable to mount the evaporator and/or the pressure governor on the vibration tamper by way of a holder that is vibration-cushioned in relation to vibration induced by the machine frame. By this means, the vibratory stress on the evaporator and/or pressure governor is reduced, especially under working conditions, and the functional reliability is thus increased.

Basically, the holder of the evaporator and/or pressure governor can be disposed at almost any position on the vibration tamper, wherein here again, preference is given to positioning the holder of the evaporator and/or pressure governor, especially directly on the superstructure and particularly on the guide bar on the vibration tamper, especially via at least one vibration dampener. With this arrangement, the already frequently provided vibration attenuation of the guide bar is thus also beneficial to the evaporator and/or the pressure governor, preferably supplemented by a further damping stage between the guide bar and the holder of the evaporator and/or pressure governor.

The holder for the evaporator and/or pressure governor can be an independent component or alternatively part of the storage container holding means. In the latter case, the holder is, in other words, thus an integral component of the storage container holding means, which is thus responsible for accommodating the at least one storage container, at the same time for additionally holding the evaporator and/or the pressure governor.

Preferably, the vibration tamper comprises an external oil cooler for the reduction of the engine oil temperature under working conditions. This can take into account the possibly higher operating temperatures incurred during the combustion of liquid gas compared with gasoline powered or diesel powered driving engines.

For reasons of safety, it is preferred that the vibration tamper comprises a tilt switching system, particularly, a tilt sensor and/or an oil pressure sensor. The essential property of the tilt switching system is that it forcibly switches off the driving engine when the vibration tamper exceeds a predetermined maximum inclination relatively to a normal position thereof. This ensures, for example, that the vibration tamper is not started, or operation thereof is not continued, when it has assumed an improper position, for example, when it is in a lying state, or when it has toppled over. For this purpose, the tilt switching system can comprise, for example, a suitable control unit, which evaluates the measured data ascertained by the tilt sensor and/or oil pressure sensor and then appropriately influences the engine timing gear and/or engine valve gear when the permissible angle of inclination as been exceeded. The tilt sensor can be a position sensor, for example. The oil pressure sensor detects the oil pressure in the oil pipe system of the driving engine. If the vibration tamper exceeds a specified angle of inclination, for example, by toppling over, the oil pressure conditions at suitable points in the oil pipe system change drastically, so that, by this means, the angle of inclination of the vibration tamper can be indirectly monitored.

A further preferred embodiment under safety-relevant aspects consists in that an automatic shutdown system is integrated in the vibration tamper such that it allows the flow of liquid gas into or through the evaporator or the above described machine element comprising an evaporator and a pressure governor only when there is adequate negative pressure in a suction pipe of the motor. The automatic shutdown system, thus, represents a kind of feedback which ensures that liquid gas is passed on to the evaporator only when the driving engine is in operation and an appropriate negative pressure is present in the suction pipe of the driving engine. When the driving engine is switched off, however, there is no longer a negative pressure in the suction pipe. The automatic shutdown system now ensures that in this case no more liquid gas can flow into or through the evaporator or at least the common machine element comprising an evaporator and a pressure governor according to the above statements, so that the formation of unburned amounts of gaseous liquefied gas is significantly minimized. The automatic shutdown system can for this purpose be likewise electronically controlled, for example, and can additionally comprise a control unit, a pressure sensor, and a switching valve controlled by the control unit in accordance with the pressure values in the suction pipe as ascertained by the pressure sensor, more particularly, close to the evaporator. Alternatively, a mechanical solution is also conceivable, in which a suction pipe comprising a membrane provides a pressurized connection between the suction pipe and a machine part communicating with the fuel supply of the driving engine, such as, more particularly, the evaporator, wherein, for example, a valve can be provided at the evaporator input, which valve is switched to its opened position by the negative pressure present in the suction pipe against a restoring force. Specifically, the automatic shutdown system can, for example, control a check valve, by means of which it can, for example, cause blockage of the flow of fuel to the evaporator when there is no adequate negative pressure in the suction pipe leading to the driving engine. If an adequate negative pressure develops in the suction pipe, for example, when the driving engine starts, the automatic shutdown system, however, will allow fuel to flow freely towards the evaporator through the pressure governor. The automatic shutdown system thus has a controlling function, whether or not the pressure governor allows liquid gas to flow to the evaporator.

It is also possible to dispose the piping system at least partially within the guide bar. More particularly, pipe sections in the form of connecting hose can be placed in the guide bar that is frequently in the form of bent and/or welded tubes or can be partially threaded through sections, by means of which, in addition to particularly efficient space saving, there is achieved good mechanical protection of these pipe sections in relation to the environment.

Liquid gas is in its gaseous state heavier than air and, thus, tends to accumulate in the region of the ground in the case of uncontrolled outflow thereof. This is particularly relevant, for example, when the vibration tamper according to the present invention is used for ditching in a trench or similar operating site. In a further preferred embodiment, the vibration tamper therefore comprises a gas sensor that is adapted to determine the gaseous liquid gas concentration in the external environment of the vibration tamper. Furthermore, there is provided emergency shutdown means, for example, a suitable control unit connected to a gas sensor, which switches off the driving engine when the gas sensor detects that a predetermined concentration level in the external environment of the vibration tamper has been exceeded.

BRIEF DESCRIPTION OF THE DRAWINGS

The present invention is explained below with reference to the exemplary embodiments illustrated in the figures, in which:

FIG. 1 is a side view of a generic vibration tamper;

FIG. 2*a* is a perspective oblique view taken from the right to the front of a vibration tamper powered on liquid gas;

FIG. 2*b* is a diagrammatic rear view of the vibration tamper shown in FIG. 2*a;*

FIG. 7 is an elementary circuit diagram of a vacuum switching system; and

FIG. 8 is a diagrammatic drawing of a tilt switching system.

DETAILED DESCRIPTION OF THE INVENTION

Figure 3:
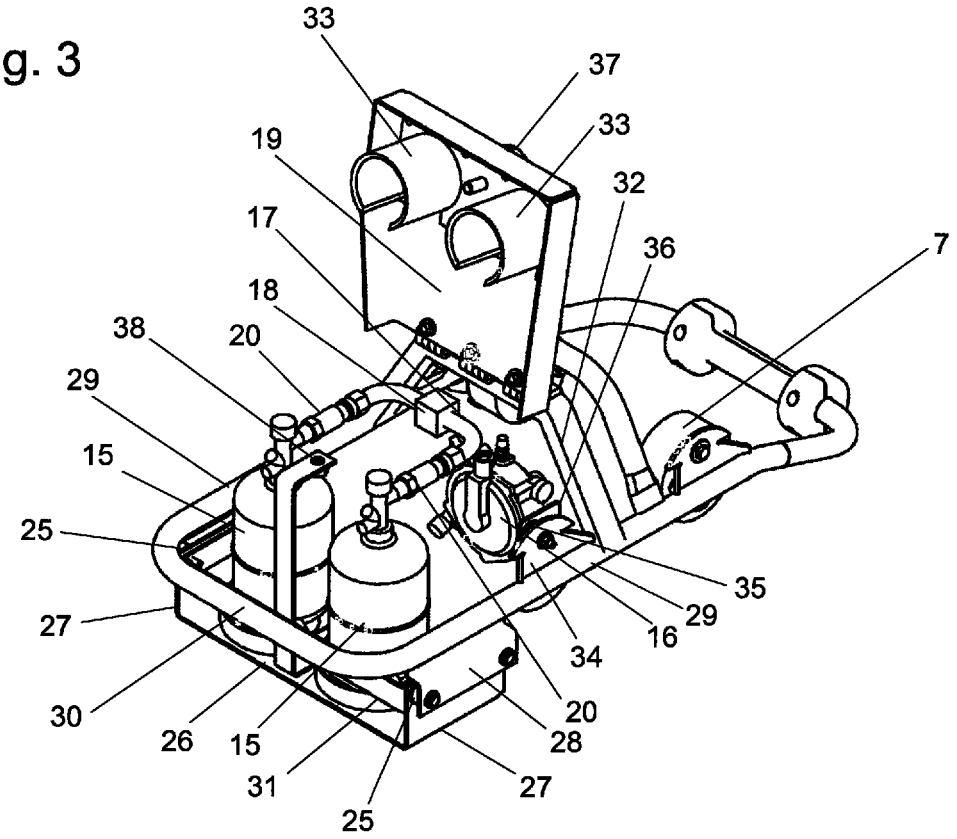
FIG. 3 is a perspective detailed diagrammatic view of the guide bar as shown in FIGS. 2*a* and 2*b* taken obliquely from the rear right.

Like components are designated in the figures by like reference signs. Recurrent components are not necessarily individually denoted in each figure.

FIG. 1*a* shows a vibration tamper 1 comprising a superstructure 2*a*, wherein the superstructure 2*a* comprises a driving engine 3 and a guide bar 4. There are additionally present a substructure 2*b* comprising a compactor base 5 including a base plate 9 and a transport handle 8. The substructure 2*b* is linked to the superstructure 2*a* via a bellows 6. The guide bar 4 and the driving engine 3 on the superstructure 2*a* are indirectly interconnected via a machine frame 10 or interconnecting console 10. Inside the bellows 6 there is disposed a power transmission system, for example, a connecting rod, which converts the rotational driving power of the driving engine 3 to a linear motion and transfers it to the compactor base 5. Between the driving engine 3 and the compactor base 5, there is thus present, in all, a driving transmission 11, which is not described in greater detail and is known per se and by means of which the driving energy of the driving engine 3 is transferred to the compactor base 5. In operation, the compactor base 5 tamps in an approximately vertical direction along the compactor axis S, for example, at a frequency of approximately 10 Hz, over the road subsurface U and compresses the subground material. Guidance of the vibration tamper 1 takes place manually by means of the guide bar 4, which is mounted via resilient damping bearings 7 on the machine frame of the superstructure 2*a*. The main working direction a is that direction of motion of the vibration tamper under working conditions, in which the compactor axis S is forwardly inclined in relation to the horizontal ground level and in which it automatically moves under working conditions.

The vibration tamper 1 is classified as a so-called "walk-behind machine", whose overriding common feature resides in the fact that during operation the machine operator is walking behind the machine while guiding the ground compacting machine. Correspondingly, the main working direction a is also the direction of advance counter to the region of the guide bar 4 protruding from the machine.

One aspect of the present invention resides in the fact that the driving engine 3 is one powered by liquid gas. This is further illustrated in FIGS. 2*a* to 8 with reference to the vibration tamper 1.

FIGS. 2*a* to 4 illustrate further aspects concerned with the integration of the liquid gas powered driving engine 3 in the vibration tamper 1. In addition to the liquid gas powered driving engine 3 itself, elements on the superstructure 2*a* of the vibration tamper 1, particularly, the liquid gas supply system, are storage container holding means 14, such as a storage container holder, storage containers for liquid gas 15, an evaporator/pressure governor system 16, a piping system 17, an attachment means 18, and a protective cover 19.

The liquid gas required for operation of the driving engine 3 is stored in the case of the vibration tamper 1 in the storage containers 15 on the vibration tamper 1 on the superstructure 2*a* itself. More specifically, in the case of the present exemplary embodiment as shown in FIGS. 2*a* to 4, the storage containers are two 0.425 kg gas cylinders, which are replaceably disposed in the storage container holding means 14 and directly stand on its base plate 26. As is visible, for example, in FIG. 3, the two gas cylinders 15 are in each case connected to the attachment means 18 via a quick coupler 20, which comprises, in addition to the end connectors 21 directed towards the quick coupler 20, a collecting block 22, the outlet side of which is connected to the piping system 17 leading to the driving engine 3. The two storage containers 15 are thus parallel to each other, so that liquid gas can be drawn from the storage containers 15 towards the piping system 17 simultaneously via the attachment means 18. The piping system 17 is thus functionally a gas supply line, through which the driving engine 3 can be effectively supplied with liquid gas. The piping system 17 can comprise for this purpose flexible and/or rigid piping, valve connections, etc.

The liquid gas coming from the storage containers 15 is initially in a substantially liquid state. However, the driving engine 3 burns the liquid gas in the gaseous state. Between the driving engine 3 and the storage containers 15 there is disposed in the piping system 17 therefore an evaporator/pressure governor unit 16, to the inlet of which liquid liquefied gas is fed from the storage containers 15 and the outlet of which passes gaseous liquid gas on to the driving engine 3. The evaporator/pressure governor unit 16 is, in the present exemplary embodiment, a coherent component or a multifunctional module, in which an evaporator 23 and a pressure governor 24 are disposed, as described, for example, with reference to FIG. 6.

FIGS. 2*a* to 3 illustrate, inter alia, the vibration-cushioned mounting of the storage container holding means 14 on the superstructure 2*a* relative to the machine frame 10 on the superstructure 2*a*. Due to the arrangement of the storage container holding means 14 on the guide bar 4, vibration attenuation of the machine frame 10 relative to the storage container holding means 14 is already achieved by the damping bearings 7 between the guide bar 4 and the machine frame 10. In the present exemplary embodiment, a further damping stage including the damping elements 25 is additionally provided between the guide bar 4 and the storage container holding means 14. The storage container holding means 14 is thus mounted an the guide bar 4 via the damping stage 25, although direct mounting of the storage container holding means 14 on the guide bar 4 is also possible and is included within the scope of the present invention. The storage container holding means 14 comprise substantially a trough shaped basic body having a base plate 26 and two side walls 27 disposed in the lateral marginal area of the base plate 26 and rising in the vertical direction. By means of said side walls 27, the trough-like storage container holding means 14 are articulated by means of the damping elements 25 to retaining lugs 28 rigidly attached to the guide bar 4. These retaining lugs 28 are connected to the side beams 29 of the guide bar 4. The storage container holding means 14 are in other words connected at two mutually opposing end regions to the guide bar 4 in a vibration-cushioned manner, so that vibration, including that induced in the guide bar 4, is transferred in a damped state to the storage container holding means 14. Particularly, FIG. 3 shows that the storage container holding means 14 are further set at a distance as far as possible from the damping bearings 7 in the direction of the grasping region 30 between the side beams 29 of the guide bar. By this means, the storage container holding means 14 can be implemented as a kind of vibration-balancing counterweight for the purpose of further reducing vibration in the guide bar.

On the storage container holding means 14 there is further provided a lateral guard 31, which supplements the protective action of the heavy-duty and solid-faced side walls 27 towards the rear side of the vibration tamper 1 or towards the machine operator. More specifically, the lateral guard 31 is a transversal strut, which extends between the side walls 27 in the rear region of the storage container holding means 14.

Further protection of the storage container 15 disposed in the storage container holding means 14 is afforded by the protective cover 19. The protective cover 19 is, more specifically, a protective cover pivotally disposed on a transverse spar 32 of the guide bar, which protective cover is capable of being pivoted down on to the storage containers 15 under working conditions, as shown in FIGS. 2*a* and 2*b* and, for example, is capable of being pivoted up for the purpose of replacing the storage container 15, as shown in FIG. 3. In the pivoted up state, the protective cover 19 thus uncovers the storage containers 15 such that they can be easily and simply removed from the storage container holding means 14 or replaced therein. In the pivoted down state, the protective cover 19 prevents damage occurring to the storage container 15 from above and thus also to the regions of the attachment means 18 and of the conduit system 17 that are covered by the protective cover 19. The protective cover 19 also comprises a locking screw 37, by rotation of which the protective cover 19 can be locked in the closed position, as shown in FIGS. 2*a* and 2*b*. The locking screw 37 engages for this purpose in a mating counterpart 38 on the storage container holding means 14. This prevents the protective cover 19 from jumping up in an uncontrolled manner under working conditions.

In addition to the substantially solid-faced protective hood, the protective cover 19 further comprises two protective tubes 33, which are disposed on the interior surface of the protective cover 19 and protrude in the direction of the storage container 15. The protective tubes 33 are configured such that, in the pivoted down state of the protective cover 19, they at least partially cover the connecting regions of the valves on the attachment means 18 directed towards the storage containers 15 and surround the sides thereof, so that in this way there is obtained additional protection of this highly sensitive region in terms of safety. For this purpose, a slotted recess is provided in each of the protective tubes, through which recess the connecting means are guided for the purpose of connecting the storage container 15 to the attachment means 18.

Another feature of the vibration tamper 1 is the arrangement of the evaporator/pressure governor unit 16 on the guide bar 4 in a likewise vibration-cushioned manner with regard to the machine frame 10 and with regard to the guide bar. Between the evaporator/pressure governor unit 16 (that is, the relevant holding device 36 that serves to hold the evaporator/pressure governor module 16) and the retaining lug 34 on the guide bar 4, there is, thus likewise, present a damping element 35, so that vibration of the guide bars is transferred in a damped manner to the evaporator/pressure governor unit 16.

Figure 4:
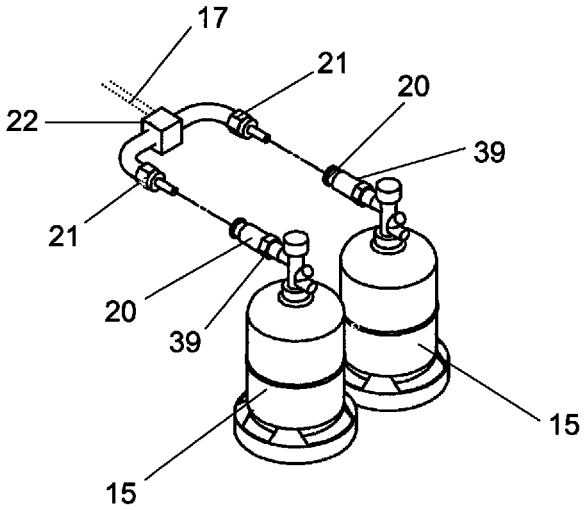
FIG. 4 is a detailed diagrammatic view of the attachment means as shown in FIG. 3.

FIG. 4 illustrates the basic function of the quick couplers 20. These comprise the end connectors 21 disposed on the flexible pipe ends of the attachment means 18. On the storage containers 15 there are provided appropriate coupling counterparts 39 adapted to establish a gastight transfer connection between the storage container 15 and the piping system 17 for the accommodation of the connectors 21. More specifically, the quick coupler 20 is adapted such that a valve will only be opened when a gastight fluid communication route has been established, and the quick coupler 20 will only be released after the relevant valves have been closed. The quick couplers 20 can be coupled and uncoupled by carrying out purely manual pushing and turning movements on the connectors 21 relatively to the coupling counterparts 39, so that no specific tool is necessary for replacing the storage container 15, for example.

Figure 5:
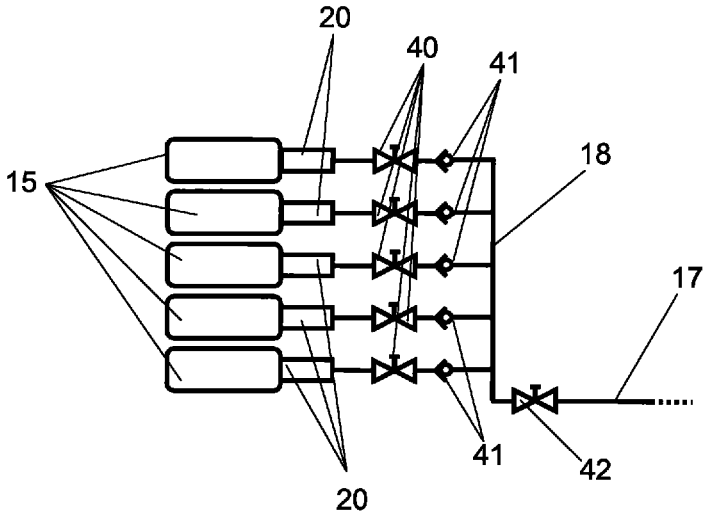
FIG. 5 is an elementary circuit diagram of an attachment means comprising a plurality of storage containers connected in parallel.
Figure 6:
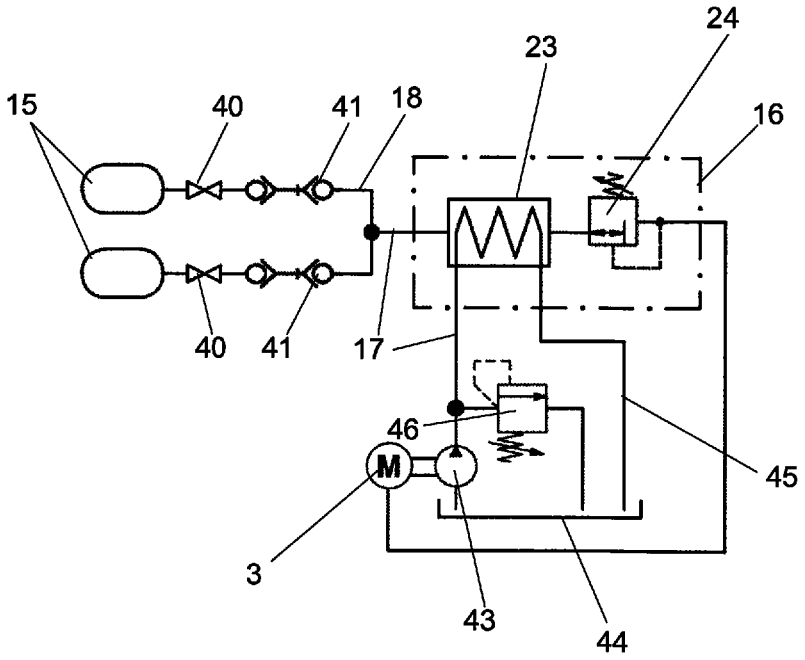
FIG. 6 is an elementary circuit diagram of a heat input port to the evaporator fed with engine oil.

FIG. 5 is an elementary circuit diagram and illustrates, in an alternative embodiment to that shown in FIGS. 2*a* to 4, the parallel arrangement of more than two storage containers 15 in the storage container holding means 14. The storage containers 15 shown in FIG. 5 are, for example, cartridges having a maximum capacity of 1000 ml. The cartridges 15 are connected to the attachment means 18 by means of quick couplers 20 as described above. Each pipe connection between a cartridge 15 and the attachment means 18 is also provided with a stopcock 40 and a check valve 41 mounted down-stream, as regarded in the outflow direction. The check valve 41 substantially serves the purpose of automatically closing the attachment means 18 with respect to the environment when a storage container 15 has been removed from the closing device 18, for example, for the purpose of replacement. Thus, the check valve 41 automatically ensures that the liquid gas present in the other storage containers will not flow out through that connecting arm from which the storage container 15 had been removed. Between the attachment means 18 and the remaining piping system 17 leading to the driving engine 3, there is also provided a central stopcock 42, by means of which the transfer of liquid gas from the storage containers 15 to the driving engine 3 can thus be centrally blocked or unblocked. It goes without saying that the diagram shown in FIG. 5 can be almost arbitrarily extended or reduced to accommodate different numbers of storage containers 15.

To achieve perfect functioning of the liquid gas powered driving engine 3, it is important that the liquid gas be supplied in the gaseous state. In order to make it possible to achieve virtually quantitative volatilization of the liquefied gas, there is disposed between the attachment means 18 and the driving engine 3 in the piping system 17 the said evaporator/pressure governor unit 16 comprising the evaporator 23 and the pressure governor 24. The pressure governor 24 is connected down-stream of the evaporator 23, as regarded in the direction of fluid effluent flow towards the driving engine 3. The essential objective of the pressure governor 24 is to ensure a constant pressure of the gas supplied to the driving engine 3. The pressure governor 24 is an automatically effective pressure governor, which automatically executes the relevant pressure control. The evaporator 23 is intended, on the other hand, to effect complete volatilization of the liquefied gas issuing from the storage containers 15. In the present exemplary embodiment there is thus provided, for this purpose, means for heating the evaporator 23, in that warmed engine oil is fed to the evaporator 23. For this purpose, there is provided, in the exemplary embodiment illustrated in FIG. 6, an oil pump 43 driven by the driving engine 3, which oil pump pumps warmed engine oil from the engine oil sump 44 towards the evaporator 23 and recycles the same from the evaporator 23 back to the engine oil sump 44. In this evaporator oil circuit 45 there is further disposed a pressure relief valve 46.

FIG. 7 illustrates by way of example the basic modus operandi of an automatic shutdown system for the vibration tamper 1. The automatic shutdown system causes the gas supply to the driving engine 3 to be blocked when the driving engine 3 demands no fuel, or when the driving engine 3 is switched off. The basic principle of the automatic shutdown system illustrated in FIG. 7 involves the fact that an adequate negative pressure predominates in the suction pipe 46 between the carburetor 47 and the driving engine 3 only when a negative pressure is produced in the suction pipe 46 of the driving engine 3 by the rotary movement of the driving engine 3 and the concomitant motion of the piston. For this reason, provision is made for a feedback to be present between the negative pressure in the suction pipe 46 leading to the evaporator/pressure governor unit 16, which feedback permits the transfer of liquid gas through the evaporator/pressure governor unit 16 only when an adequate negative pressure predominates in the suction pipe 46. For this purpose, a pressure signal line 48 is provided between the suction pipe 46 and the evaporator/pressure governor unit 16, by means of which signal line a suitable cut-off device in the evaporator/pressure governor unit 16 is controlled such that an outflow of liquid gas from the evaporator/pressure governor unit 16 to the driving engine 3 is only possible when there is adequate negative pressure in the suction pipe 46.

FIG. 8 finally illustrates the operating principle of a tilt switching system. The essential element of the tilt switching system is a sensor 49, by means of which it is possible to detect at least when a predetermined maximum degree of tilt of the vibration tamper 1 in relation to the horizontal ground level of the road subsurface U has been exceeded. The degree of inclination describes the tilt angle of the compactor axis S of the vibration tamper 1 in relation to a reference perpendicular standing on the ground horizontal. The data ascertained by the sensor 49 are transferred to a control unit 50. When the control unit 50 ascertains that the limit of tilt has been exceeded, it stops the engine. This can take place, for example, by disconnecting the triggering current supply 51 or by comparable measures. Additionally or alternatively, for example, also shutoff valves or similar measures can be triggered by the control unit 50 in this case, in order to prevent an uncontrolled outflow of liquid gas from a toppled vibration tamper 1.

While the present invention has been illustrated by description of various embodiments and while those embodiments have been described in considerable detail, it is not the intention of Applicants to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicants' invention.

What is claimed is:

1. A vibration tamper for ground compaction, comprising:

a superstructure comprising a drive engine, which is mounted on a machine frame, and a guide bar;

a substructure comprising a compactor base driven by the drive engine and a compactor plate; and a drive line, configured to establish a drive connection between said driving engine and said compactor base such that said compactor base can be moved relatively to the superstructure along a compactor axis (S) while executing at least one compacting amplitude, wherein the driving engine is a liquified petroleum gas powered driving engine, said superstructure comprises at least two storage containers for liquified petroleum gas, each of the at least two storage containers comprising a cartridge having a maximum filling capacity of not more than 1000 ml, and a gas supply line is provided through which evaporated liquified petroleum gas is supplied to said driving engine, wherein the at least two storage containers are replaceably disposed in a storage container holder disposed on said guide bar between two side beams of said guide bar, the storage container holder comprising a holding device for releasable fixation of each of said at least two storage containers in said storage container holder, and a lateral guard which at least partially shields each of said at least two storage containers in a respective side region thereof from the environment, and further wherein said at least two storage containers are connected in parallel to a piping system, including to said gas supply line, via a quick coupling system.

2. The vibration tamper according to claim 1, wherein the storage container holder comprises at least one of the following features:

a) said storage container holder is vibration-cushioned relatively to vibration induced in the machine frame;

b) said storage container holder is disposed on said guide bar in a vibration-cushioned manner; and c) said storage container holder is disposed on said guide bar between the guide bar mount on said machine frame and the rear grasping region on said guide bar, with respect to the main working direction.

3. The vibration tamper according to claim 1, wherein a protective cover is provided which is adapted to at least partially cover at least one storage container.

4. The vibration tamper according to claim 3, wherein said protective cover comprises at least one of the following features:

a) said protective cover is mounted for rotation on said guide bar;

b) said protective cover has a locking means for arresting said protective cover in a closed position;

c) said protective cover has a holding device for fixation of at least one storage container in said storage container holder, wherein said holding device comprises:

a resilient pressure applying element which is configured such that it exerts an effective contact pressure on said at least one storage container in said storage container holder in a closing direction of the protective cover, and/or a retaining and protective sleeve, which in its holding state, comes to bear, at least partially with its end marginal region, against at least one storage container.

5. The vibration tamper according to claim 1, wherein in said piping system there is provided, between a gas supply or at least one of said two storage containers and said driving engine, an evaporator adapted to ensure complete volatilization of the liquefied petroleum gas.

6. The vibration tamper according to claim 5, wherein said evaporator has a heat input port to which heat is supplied by way of at least cooling air warmed by the driving engine or by way of an oil circulation containing engine oil.

7. The vibration tamper according to claim 5, wherein said evaporator is mounted by a holder on the vibration tamper, wherein said holder is vibration-cushioned relatively to vibration induced in said machine frame.

8. The vibration tamper according to claim 7, wherein said holder comprises at least one of the following features:

a) said holder is disposed on said guide bar of the vibration tamper by way of at least one vibration dampener; and/or b) said holder is part of said storage container holder in which the at least two storage containers are disposed.

9. The vibration tamper according to claim 1, wherein said vibration tamper comprises at least one the following features:

a) an external oil cooler for the reduction of the engine oil temperature in said driving engine under working conditions;

b) a tilt switching system, comprising a tilt sensor and/or an oil pressure sensor; and/or c) a piping system is at least partially disposed within said guide bar.

10. The vibration tamper according to claim 1, wherein an automatic shutdown system is provided which is configured such that said automatic shutdown system permits liquified petroleum gas to flow through an evaporator only when there is an adequate negative pressure in the suction pipe of said driving engine, and further wherein said automatic shutdown system triggers, in a pressure governor, blocking and unblocking of the flow of fuel.

11. The vibration tamper according to claim 1, wherein a gas sensor is provided which is adapted to determine the liquified petroleum gas concentration in the external environment of said vibration tamper, and an emergency shutdown is provided which switches off said driving engine when said gas sensor detects a predetermined concentration level in the external environment of the vibration tamper.

12. The vibration tamper according to claim 1, wherein said cartridge comprises one of a screw valve type cartridge or a bayonet valve type cartridge.

13. The vibration tamper according to claim 1, wherein each of said at least two storage containers has a maximum filling capacity for liquified petroleum gas ranging from 400 ml to 1000 ml.

14. The vibration tamper according to claim 13, wherein said cartridge comprises one of a screw valve type cartridge or a bayonet valve type cartridge.

* * * * *